United States Patent [19]

Toenjes

[11] 4,274,227

[45] Jun. 23, 1981

[54] OBSTRUCTION SENSOR FOR ELECTRO-MECHANICALLY OPERATED GARAGE DOORS

[75] Inventor: Robert B. Toenjes, Waverly, Iowa

[73] Assignee: Chamberlain Manufacturing Corporation, Elmhurst, Ill.

[21] Appl. No.: 71,113

[22] Filed: Aug. 30, 1979

[51] Int. Cl.[3] ..... E05F 15/02

[52] U.S. Cl. ..... 49/28; 49/199

[58] Field of Search ..... 49/26, 28, 197, 199, 49/200

[56] References Cited

U.S. PATENT DOCUMENTS

| | | | |
|---|---|---|---|
| 1,258,439 | 3/1918 | Ogden | 49/200 |
| 1,558,886 | 10/1925 | Hynes . | |
| 1,959,292 | 5/1934 | Morris . | |
| 2,803,454 | 8/1957 | Tatro | 49/28 X |
| 2,826,658 | 3/1958 | Jackson . | |
| 3,289,350 | 12/1966 | Moody | 49/28 |
| 3,439,727 | 4/1969 | Perl . | |
| 3,625,328 | 12/1971 | Carli . | |
| 3,719,005 | 3/1973 | Carli . | |
| 3,728,605 | 4/1973 | Purtilo . | |
| 3,851,125 | 11/1974 | Deming et al. | 49/28 X |
| 3,996,697 | 12/1976 | Bailey et al. . | |

*Primary Examiner*—Kenneth Downey

*Attorney, Agent, or Firm*—Hill, Van Santen, Steadman, Chiara & Simpson

[57] ABSTRACT

An obstruction sensor for an electro-mechanically operated garage door which utilizes a bracket for supporting one end of the trolley that carries the door and which is driven by the motor either through a chain or worm and wherein an obstruction encountered by the door will cause the rail to move relative to a fixed bracket thus causing a reversing switch to be energized due to relative motion between the fixed bracket and the rail which will cause the motor driving circuit to reverse the motor thus causing the door to move away from the obstruction.

7 Claims, 6 Drawing Figures

OBSTRUCTION SENSOR FOR ELECTRO-MECHANICALLY OPERATED GARAGE DOORS

BACKGROUND OF THE INVENTION

1. Field of the Invention

This invention relates in general to obstruction sensors for closure operators as, for example, electro-mechanically operated garage doors.

2. Description of the Prior Art

Residential garage door openers commonly use an obstruction sensing system for limiting the output torque of the electro-mechanical drive. These prior art systems generally are insensitive to obstructions which occur when the door is in the last few feet of its closing travel due to the geometry of the forces involved. Thus, such prior art systems at times are incapable of reversing the door when obstructions were encountered during the last few feet of the door closing travel.

SUMMARY OF THE INVENTION

The present invention provides a simple slotted wall bracket and an electrical switch that allows an electro-mechanical operated garage door to sense an obstruction which may be encountered when the door is closing. The sensing of the obstruction will close the switch which is connected to the motor controller causing the mechanism to reverse and open the door. The door may be driven downwardly by its closing mechanism through a chain drive, a screw drive or other system. The motor and one end of the rail are supported by suitable brackets or otherwise from a frame structure and the opposite end of the rail is supported in the bracket of the invention and a crosspin is attached to the rail and receivable in a pair of slots of the bracket and the rail is biased to hold the crosspin in a first position in the slotted bracket. When an obstruction is encountered, the end of the rail moves relative to the bracket thus moving the crosspin in the slots of the bracket which motion causes a reversing switch to be actuated so as to reverse the direction of the door.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
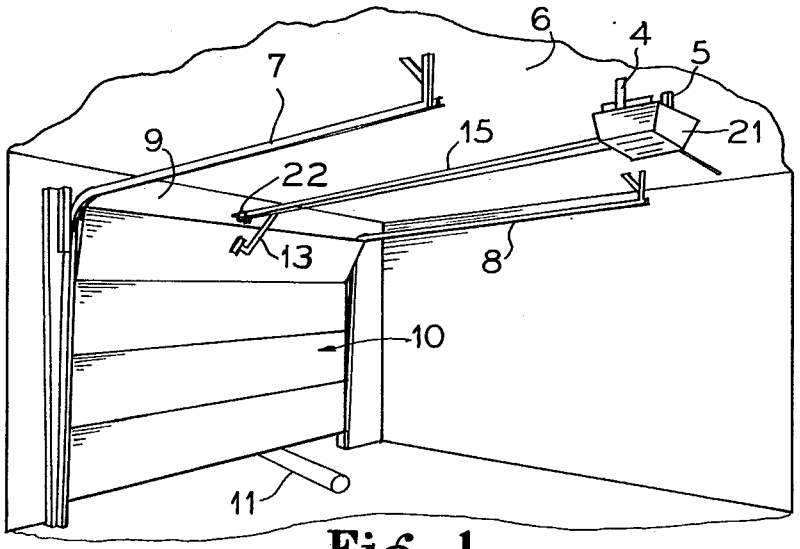
FIG. 1 is a perspective view of a garage door operator.

FIG. 1 illustrates a garage door 10 which is provided with suitable rollers not shown that are movable on tracks 7 and 8. A garage door operator 21 is supported from the ceiling 6 with suitable arms 4 and 5 which are connected to the motor housing 21 by pivot pins 3. The other end of the rail 15 is connected to the bracket 22 of the invention which supports the rail on the wall 9 above the garage door 10.

Figure 2:
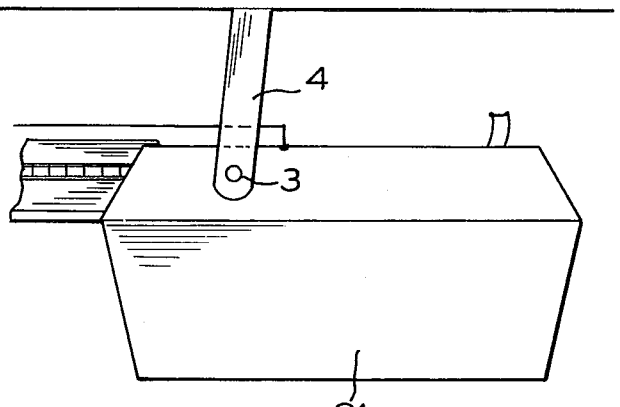
FIG. 2 is a side plan view of a chain driven garage door operator according to the invention.
Figure 2:
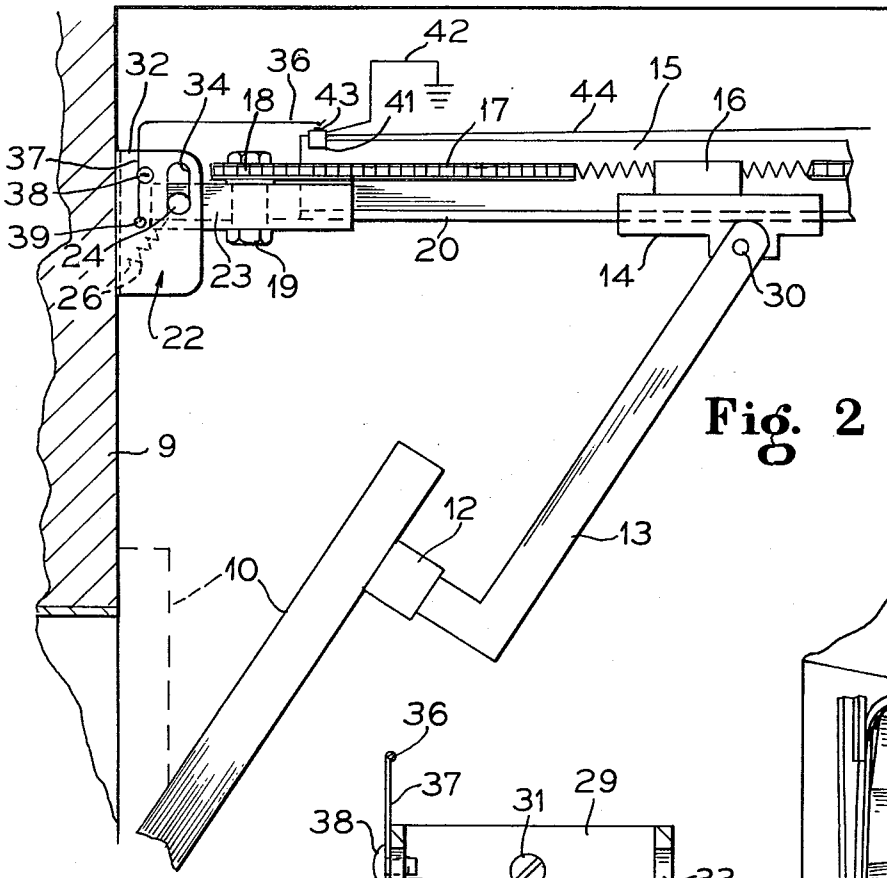

As shown in greater detail in FIG. 2, the garage door 10 has a bracket 12 to which an arm 13 is attached which is connected by a pivot pin 30 to a trolley 14 which is driven on the horizontal portion 20 of the rail 15 by a chain 17 that is connected to the upper portion 16 of the trolley 14.

The chain 17 passes around a sprocket wheel 18 which is connected to a bracket 23 by a bolt 19 and also passes into the motor housing 21 where it is driven by the motor so as to move the garage door up and down.

Figure 3:
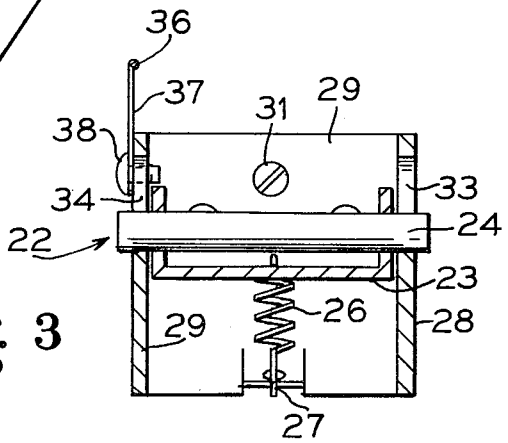
FIG. 3 is a sectional view taken on line III—III in FIG. 2.

The bracket 23 is U-shaped in section as shown in FIG. 3 and extends into the novel bracket 22 of the invention illustrated in greater detail in FIG. 3. The bracket 23 carries a crosspin 24 which extends through slots 33 and 34 formed in the side walls 28 and 29 of the bracket 22.

A spring 26 is connected with a lower end 27 in engagement with the back wall 29*a* of the bracket 22 and has its upper end in engagement with the member 23 and/or the crosspin 24 so as to bias the crosspin downwardly in the slots 33 and 34 relative to FIGS. 2 and 3. The bracket 22 is connected to the wall 9 by a number of lag screws 31 which hold it firmly in place against the wall 9. A switch actuating arm 36 is attached to the end wall 29 of the bracket 22 by bolt 38 and has an end 39 which is receivable in an opening formed in the bracket for that purpose. The arm 36 has an upwardly extending portion 37 which carries the arm 36. The upper portion of rail 15 carries a reversing switch 41 which has a contact 43 engageable with the end of the switch arm 36. One side of the switch 41 is connected to ground by a lead 42 and the other side of the switch 41 is connected to the motor control circuit by a conductor 44.

In operation, when the garage door operator is energized so as to close the door 10, the motor drives the chain 17 to move the trolley 14 to the left relative to FIG. 2 and under normal conditions the crosspin 24 is held by the spring 26 in the bottom of the slots 33 and 34 such that the switch arm 36 does not engage switch contact 43 of switch 41 to close it. In the event an obstruction 11 is engaged by the door as illustrated in FIG. 1, the motor will continue to move chain 17 attempting to close the door and due to the reaction of the obstruction 11 on the bottom edge of the door, the rail 15 will be pivoted up about the pivot points 3 causing the end of the rail 15 adjacent the bracket 22 to move upwardly relative to FIGS. 2 and 3 against the spring 26 thus causing switch contact 43 to engage the arm 36 closing the switch 41. When the switch 41 is closed, the motor will stop and then reverse to open the door to its full position.

Thus, the invention provides reversal of the door 10 even though it is very near its closing position when an obstruction 11 is engaged.

Figure 4:
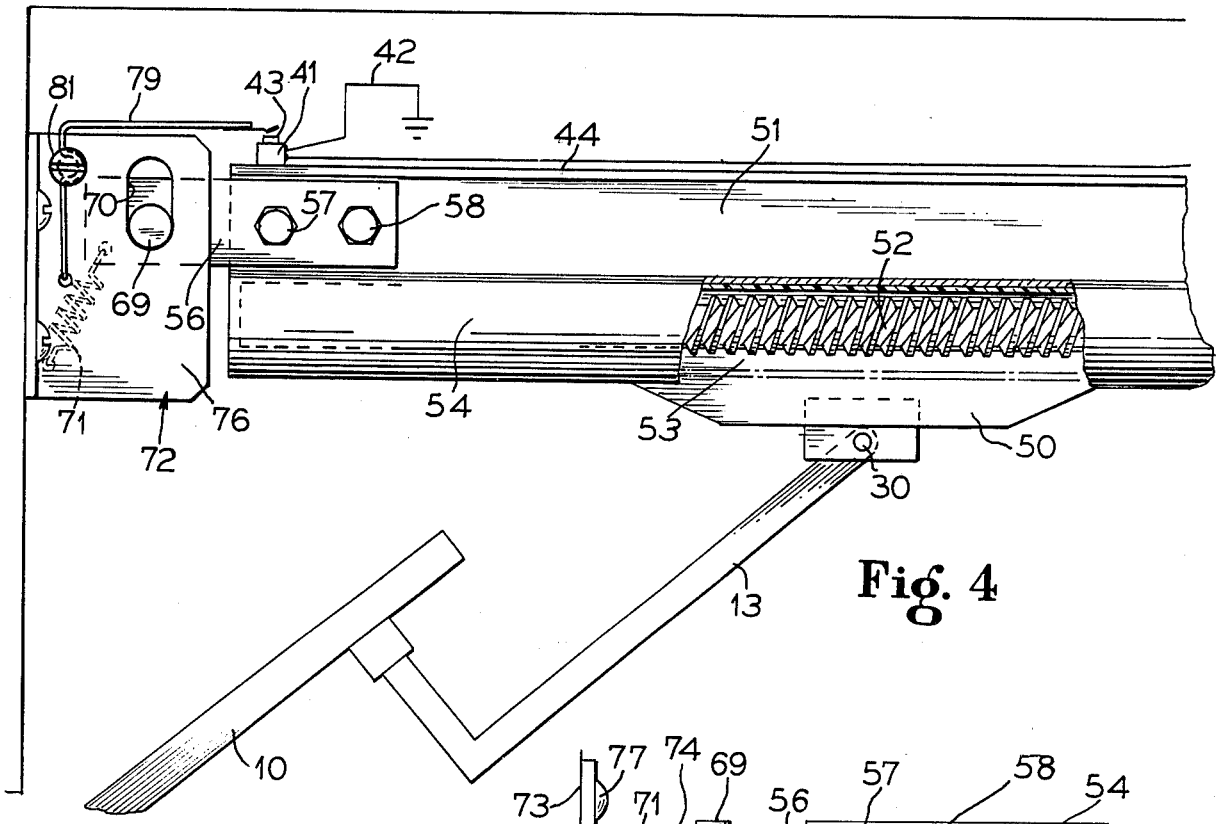
FIG. 4 illustrates a worm driven garage door actuator with a modified form of the bracket.
Figure 5:
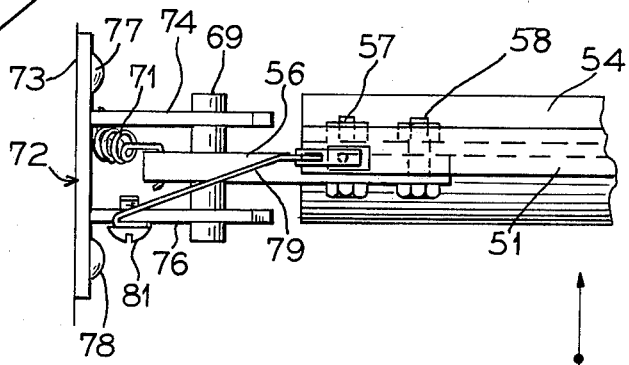
FIG. 5 is a top plan view of the bracket illustrated in FIG. 4.

A second embodiment of the invention is illustrated in FIGS. 4 and 5 wherein a worm drive garage door operator is disclosed rather than a chain drive as illustrated in FIGS. 2 and 3. In FIGS. 4 and 5, the numerals which are the same as those used in FIGS. 2 and 3 illustrate similar structures. In the embodiment illustrated in FIG. 4, the rail 51 includes a lower tubular portion 54 which carries a worm 52 which is driven by the motor so as to move a trolley 50 which has teeth 53 which engage the worm so as to move the trolley back and forth and thus raise and lower the door 10. The upper portion 51 is connected by bolts 57 and 58 to a plate 56 which carries a crosspin 69 which is receivable in slots 70 formed in the side walls 74 and 76 of the bracket 72. The crosspin 69 is connected by a spring 71 to a lower portion of the bracket 72 so as to bias the crosspin 69 and the rail 71 downwardly in the slots 70. A switch engaging arm 79 is connected by a bolt 81 to the bracket side wall 76 and a reversing switch 41 is mounted on the upper portion of rail 51 and has a switch contact 43 engageable with the arm 79 when the rail 51 moves upwardly in the slot 70 when the door 10 engages an obstruction. One side of the switch 41 is connected by lead 42 to ground and a second lead 44 is connected to the motor control circuit to cause the motor to reverse when an obstruction is encountered. The bracket 72 is connected to the wall 9 by suitable lag screws 77 and 78 as illustrated in FIG. 5, for example.

Figure 6:
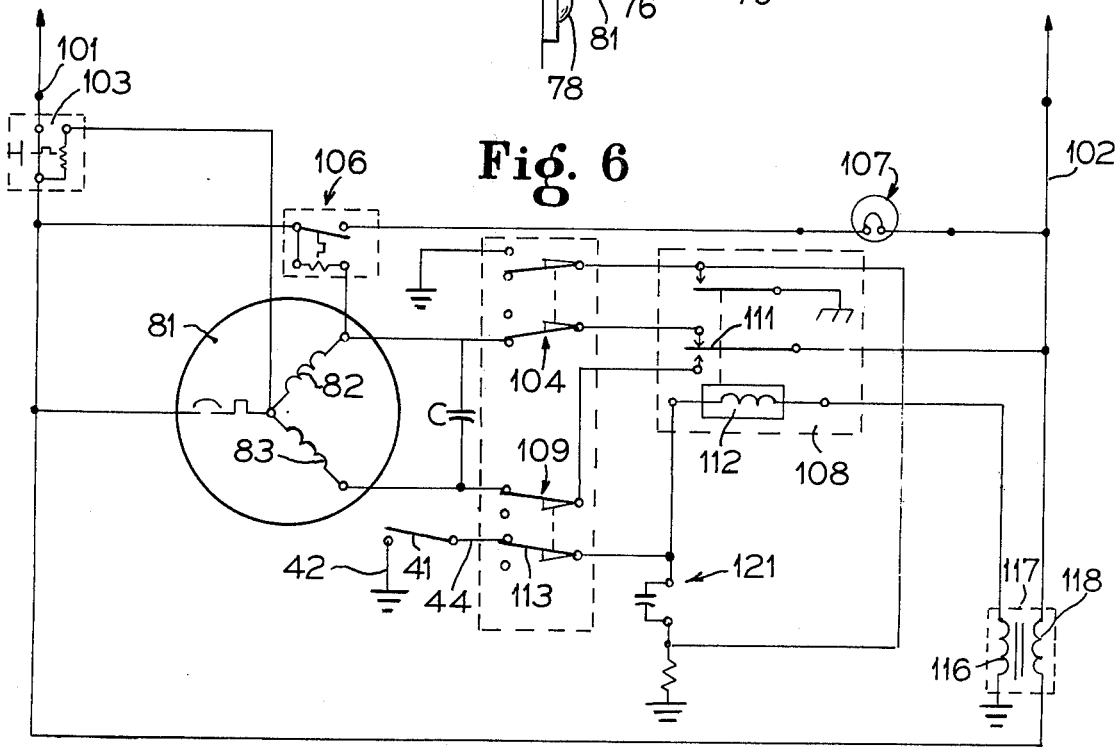
FIG. 6 is an electrical schematic illustrating the reversing switch connected with the motor drive circuit.

FIG. 6 illustrates an electrical schematic for the motor and includes a pair of power leads 101 and 102. Lead 101 is connected through a manual reset button 103 to a motor 81 which may be of the PSC type and has one winding 82 that is connected to lead 102 through the up-limit switch 104 and also through the lamp delay switch 106 and the lamp 107 and through an impulse relay 108. The other winding 83 is connected through a down limit switch 109 to a reversing switch 111 which is controlled by the impulse relay winding 112 of the impulse relay 108 and has its movable contact connected to lead 102. A capacitor C is connected across the windings 82 and 82 as shown. The obstruction switch 41 is connected to the reverse-disable switch 113 which has its other side connected to the coil 112 of the impulse relay 108 and the secondary 116 of a transformer 117 which has its primary 118 connected to opposites sides of the power supply 101 and 102. An energizing push button switch 121 is provided to energize the impulse relay 108 by applying power to winding 112 as shown.

Since motor control circuits are well known to those skilled in the art, the circuit of FIG. 6 is just one of the examples of the manner in which the obstruction switch 41 can be connected in a suitable motor control circuit for causing the stopping and reversing of the door when an obstruction is encountered and the invention is not to be limited to the specific motor control circuit illustrated.

When a garage door is closing and an obstacle is encountered, an upward reaction will be applied to the bottom edge of the door, and an upward and horizontal reaction to the right relative to FIG. 2 will be applied to the trolley 14. The vertical component will cause the rail 15 and unit 21 to rotate clockwise relative to FIG. 2, thus causing crosspin 24 to move upwardly in slots 33 and 34 which will actuate switch 41.

It is to be realized, of course, that although the crosspin has been illustrated as attached to the second end of the rail and the slots 33 and 34 are formed in the bracket 22, these could be reversed with the slot formed in the end of the rail and the crosspin mounted in the bracket. It is the relative motion between the rail and bracket caused by an obstruction which actuates the reversing switch and the particular mounting position of the switch and the actuating arm can take different forms.

It is seen that the present invention provides a novel and simple obstruction sensing and reversing circuit wherein movement of one end of the rail in a mounting bracket causes the closing of a reversing switch and although it has been described with respect to preferred embodiments, it is not to be so limited as changes and moficiations may be made therein which are within the full intended scope as defined by the appended claims.

I claim as my invention:

1. An obstacle reversing apparatus for a garage door operator comprising, a motor and motor control unit, support means pivotally supporting said motor and motor control unit, a longitudinal rail member with one end attached to said motor and motor control unit, a trolley connected to said door and movably mounted on said rail member, driving means mounted in said rail member for driving said trolley back and forth on said rail member and said driving means connected to said motor, a bracket means connected to the second end of said rail member to support it, a vertical slot formed in said bracket member, a transverse member attached to said second end of said rail member and receiveable in said slot of said bracket member, and a motor reversing switch connected to said motor mounted relative to said bracket and said second end of said rail member such that said reversing switch is actuated when an obstacle is encountered by said door which causes relative movement between said bracket and said rail due to the rails pivotal movement caused by the pivotal connection of said support means to said motor and motor control unit.

2. An obstacle reversing apparatus according to claim 1 including a spring means connected to said transverse member to bias the rail downwardly in said slot of said bracket.

3. An obstacle reversing mechanism according to claim 1 wherein said motor reversing switch is mounted on said rail, and a switch actuating arm mounted to actuate said switch when said rail moves relative to said bracket when said door encounters an obstacle.

4. An obstacle reversing apparatus according to claim 3 wherein said switch actuating arm is mounted on said bracket.

5. An obstacle reversing apparatus according to claim 1 wherein said driving means comprises an endless belt connected to said trolley and to said motor.

6. An obstacle reversing apparatus according to claim 1 wherein said driving means comprises a worm connected to said motor and to said trolley.

7. An obstacle reversing apparatus for a garage door operator comprising, a motor and motor control unit, support means pivotally supporting said motor and motor control unit, a longitudinal rail member with one end attached to said motor and motor control unit, a trolley connected to said door and movably mounted on said rail member, driving means mounted in said rail member for driving said trolley back and forth on said rail member and said driving means connected to said motor, a bracket means connected to the second end of said rail member to support it, coupling means loosely interconnecting said bracket to the second end of said rail member, and a motor reversing switch connected to said motor mounted relative to said bracket and said second end of said rail member such that said reversing switch is actuated when an obstacle is encountered by said door which causes relative movement between said bracket and said rail due to the rails pivotal movement caused by the pivotal connection of said support means to said motor and motor control unit.

* * * * *